US006722336B2

(12) United States Patent
Nieda et al.

(10) Patent No.: US 6,722,336 B2
(45) Date of Patent: Apr. 20, 2004

(54) RECOIL STARTER

(75) Inventors: Seiichi Nieda, Tokyo (JP); Hideki Hashiba, Tokyo (JP); Fumihiko Aiyama, Tokyo (JP); Isao Takahashi, Tokyo (JP)

(73) Assignees: Starting Industrial Co., Ltd., Tokyo (JP); Kioritz Corporation, Tokyo (JP)

( * ) Notice: Subject to any disclaimer, the term of this patent is extended or adjusted under 35 U.S.C. 154(b) by 56 days.

(21) Appl. No.: 10/152,121

(22) Filed: May 21, 2002

(65) Prior Publication Data

US 2002/0174848 A1 Nov. 28, 2002

(30) Foreign Application Priority Data

May 25, 2001 (JP) ..... 2001-157374

(51) Int. Cl.[7] ..... F02N 1/00
(52) U.S. Cl. ..... 123/185.14; 123/185.3
(58) Field of Search ..... 123/185.14, 185.3

(56) References Cited

U.S. PATENT DOCUMENTS 3,783,851 A 1/1974 Sherwood et al. ..... 123/185.14
4,480,605 A * 11/1984 Bloemers ..... 123/185.3
5,862,787 A * 1/1999 Unuma et al. ..... 123/185.3

* cited by examiner

*Primary Examiner*—Noah P. Kamen
(74) *Attorney, Agent, or Firm*—Baker Botts LLP

(57) ABSTRACT

A recoil starter having a driving member and a driven member, wherein the driving member further includes recoiling unidirectional rotating means. The recoiling unidirectional rotating means includes a movable locking claw member which is supported by one of the rope reel and the interlocking rotor in such a manner that it is rotatable therewith and movable in a direction along the rotational axis thereof, an urging member for urging the movable locking claw member toward the other of the rope reel and the interlocking rotor, and an engaging member mounted on the other of the rope reel and the interlocking rotor. The unidirectional rotating means is constructed in such a manner that, when the rope reel is rotated in the driving direction, the movable locking claw member is caused to contact and engage with the engaging member to thereby enable the rotation of the rope reel to be transmitted to the interlocking rotor, and that, when the rope reel is rotated reversibly to the driving direction relative to the interlocking rotor, the engagement between the movable locking claw member and the engaging member is released.

2 Claims, 9 Drawing Sheets

(A)

(B)

RECOIL STARTER

TECHNICAL FIELD OF THE INVENTION

The present invention relates to a recoil starter adapted for use in an internal combustion engine, and in particular, to a recoil starter provided with improved unidirectional rotating means for recoiling (which hereinafter will be referred to as recoiling unidirectional rotating means) designed to transmit the rotation of a rope reel to a driven member.

DESCRIPTION OF THE RELATED ART

A recoil starter adapted for use in an internal combustion engine is conventionally provided with a driving member having a rope reel, around which a recoil rope is wound, and a driven (idler) unit comprising a centrifugal ratchet mechanism. In order to start the internal combustion engine, the recoil rope (recoil handle) is pulled to revolve the rope reel, and the resulting revolution of the rope reel is transmitted via the driven member to the crankshaft of the internal combustion engine, to thereby start the engine.

The driving member also includes, in addition to the aforementioned rope reel, a spiral spring for recoiling as recoiling urging means for reversibly rotating the rope reel so as to wind the recoil rope, recoiling unidirectional rotating means for transmitting the rotation of the rope reel to the driven member, and an interlocking rotor.

In the conventional recoil starter, unidirectional rotating means generally includes a ratchet mechanism having one or more oscillating locking claws (ratchet claws), which are swingably supported by either one of the rope reel and the interlocking rotor, an urging member for urging the oscillating locking claw to move radially, and one or more engaging claws, which are attached to the other of the rope reel and the interlocking rotor. When the rope reel is rotated in the driving direction by pulling the recoil rope so as to start the internal combustion engine, the oscillating locking claws are caused to contact and engage with the engaging claws, thereby transmitting the rotation of the rope reel to the interlocking rotor.

Conversely, when the rope reel is permitted to rotate reversibly to the aforementioned driving direction by the effect of the spiral spring for recoiling after the engine is started and the recoil rope is released, the oscillating locking claws and the engaging claws are released from their engagement, whereby the rope reel and the interlocking rotor are permitted to independently rotate in the directions opposite to each other.

The recoiling unidirectional rotating means that has been mounted on this conventional recoil starter described above is constructed such that the oscillating locking claws (ratchet claws) and the engaging claws are permitted to engage with or disengage from each other via the swinging movement, in radial direction, of the oscillating locking claws, so that if a plurality of oscillating locking claws are to be mounted on the ratchet mechanism in order to enhance the reliability of power transmission, all of the oscillating locking claws are required to be independently supported swingably, and at the same time, an urging member is required to be separately attached to each of the oscillating locking claws.

As a result, the conventional recoil starter suffers from a drawback in that a large number of parts are required to be employed, its structure is complicated, it requires troublesome assembling and attachment work, and the manufacturing costs are relatively high.

Accordingly, there exists a need in the art for a recoil starter which can overcome the aforementioned disadvantages associated with the conventional recoil starter with unidirectional rotating means.

BRIEF SUMMARY OF THE INVENTION

An object of the present invention is to provide a recoil starter having recoiling unidirectional rotating means, which is reasonably simple in structure and can be easily assembled and attached, thereby making it possible to effectively reduce the manufacturing cost of the recoil starter.

These and other objects of the invention, which will become apparent with reference to the disclosure herein, are accomplished by the recoil starter according to the present invention which fundamentally includes a driving member, which is provided with a rope reel around which a recoil rope is wound to thereby enable the rope reel to be rotated by pulling the recoil rope, recoiling urging means for reversibly rotating the rope reel to thereby wind the recoil rope, and an interlocking rotor to which the rotation of the rope reel is enabled to be transmitted, and a driven member operationally coupled to the driving member, to which the rotation of the driving member is transmitted.

The driving member further includes recoiling unidirectional rotating means operationally coupled to the interlocking rotor, the recoiling unidirectional means including a movable locking claw member which is supported by one of the rope reel and the interlocking rotor in such a manner that it is rotatable integrally therewith and movable in a direction along the rotational axis thereof, an urging member for urging the movable locking claw member toward the other of the rope reel and the interlocking rotor; and an engaging member mounted on the other of the rope reel and the interlocking rotor. The unidirectional rotating means is characterized as being constructed in such a manner that when the rope reel is rotated in the driving direction, the movable locking claw member is caused to contact and engage with the engaging member to thereby enable the rotation of the rope reel to be transmitted to the interlocking rotor, and that when the rope reel is rotated reversibly to the driving direction relative to the interlocking rotor, the engagement between the movable locking claw member and the engaging member is released.

In a preferred embodiment of the present invention, the rope reel is provided with a guiding/supporting portion for fitting therein the movable locking claw member while allowing the movable locking claw member to slide along the aforementioned rotational axis, and the engaging member being formed integrally with the interlocking rotor.

Preferably, the movable locking claw member is provided with a locking claw, which includes a locking face formed perpendicular to the rotational direction of the movable locking claw member, and an inclined face located behind the locking face in the aforementioned driving direction.

The engaging member is provided with an engaging claw having an engaging face formed perpendicular to the rotational direction of the engaging member, and an inclined face located in front of the engaging face in the aforementioned driving direction.

The movable locking claw member is provided with a couple of locking claws which are spaced apart from each other along the circumference of the rotational axis at an angle of 180 degrees.

The engaging member may be provided with eight, six, four or two of the engaging claws which are spaced apart from each other along the circumference of the rotational axis at an angle of 45 degrees, 60 degrees, 90 degrees or 180 degrees, respectively.

Buffering/power-accumulating means may also be disposed at a midway of power transmission system between the driving member and the driven member.

The buffering/power-accumulating means is enabled, during the driving process by the driving member, to accumulate the power supplied by the driving process while alleviating any impact to be imposed by the driven member, the accumulated power being subsequently employed for driving the driven member.

Preferably, the buffering/power-accumulating means includes a spiral spring mechanism and is preferably provided with unidirectional rotating means for enabling the interlocking rotor to rotate only in the driving direction.

The recoil starter according to a preferred embodiment of the present invention which is constructed as previously described can be operated as follows. When the recoil rope is pulled to revolve the rope reel in the driving direction so as to start the engine, recoil urging means (spiral spring) is wound and, at the same time, the movable locking claw member which is slidably fitted in the guiding/supporting portion of the rope reel is also caused to rotate. In this case, since the movable locking claw member is being urged to move toward the interlocking rotor by urging means such as a coil spring, the locking face of the locking claw is permitted to contact and engage with the engaging face of the engaging claw of the engaging member, which is mounted on the interlocking rotor, immediately after the initiation of the rope-pulling operation (starting operation), thereby enabling the rotation of the rope reel to be transmitted to the interlocking rotor. As a result, the rope reel is permitted to rotate together with the interlocking rotor in the same direction, this rotation being successively transmitted via the driven member to the crankshaft of the internal combustion engine to thereby achieve the start-up of the engine.

Once the engine has been started, the recoil rope is released and the rope reel is forced to rotate reversibly to the driving direction by the effect of the recoiling urging means so as to rewind the recoil rope. At this moment, the inclined face of the locking claw of the movable locking claw member can not be engaged with the inclined face of the engaging claw of the engaging member even though these inclined faces are permitted to slidably contact each other. As a result, while permitting the engaging claw to successively pass over the locking claws, the movable locking claw member (the locking claws) is caused to move toward the rope reel against the urging force of the urging member, thereby permitting the engaging claw to disengage from the locking claw, whereby the rope reel and the interlocking rotor are permitted to individually rotate in the directions opposite to each other.

As explained above, since recoiling unidirectional rotating means, which is mounted on the recoil starter of the present invention, is constructed such that the engagement and disengagement between the locking claws and the engaging claws can be executed by moving the movable locking claw member provided with the locking claws in the direction along the rotational axis, a plurality of locking claws are no longer required to be supported in a manner that each of the locking claws is enabled to individually oscillate as seen in the case of the conventional ratchet mechanism provided with oscillating locking claws. Moreover, the movable locking claw member is only required to be urged to move toward the interlocking rotor by making use of a single urging member. The locking claws, therefore, are no longer required to be separately provided with an individual urging member. As a result, it is now possible to reduce the number of parts to be employed, to simplify the structure of the recoil starter, and to easily assemble and attach the recoil starter, thus making it possible to effectively reduce the manufacturing cost thereof.

Furthermore, since buffering/power-accumulating means, which includes, e.g., a spiral spring mechanism, is interposed at a midway of the power transmitting system between the driving member and the driven member, it is possible to minimize fluctuation in the rope-pulling force so as to allow for a smooth rope-pulling operation, thus enabling even a person having weak physical strength to easily start the engine.

DETAILED DESCRIPTION OF THE EXEMPLARY EMBODIMENTS

The present invention will be further explained with reference to the drawings depicting embodiments of the recoil starter according to the present invention.

Figure 1:
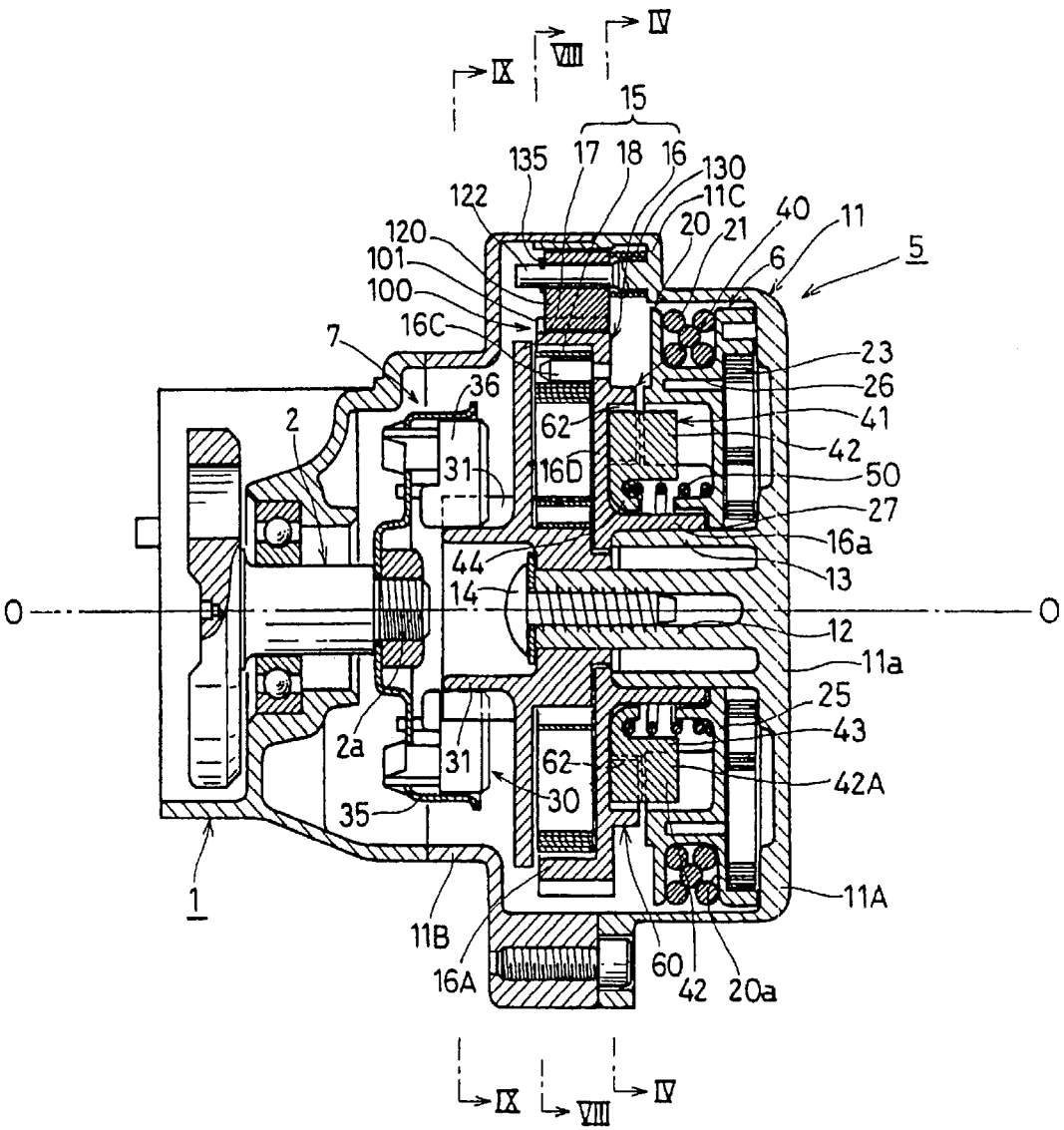
FIG. 1 is a cross-sectional view of a recoil starter representing one embodiment of the present invention.

FIG. 1 is a cross-sectional view of a starter representing one embodiment of the recoil starter according to the present invention. Referring to FIG. 1, a recoil starter 5 is designed so as to be disposed close to one end 2*a* of a crankshaft 2 of an internal combustion engine, such as a small air-cooled internal combustion engine of 23 mL to 50 mL in displacement. The recoil starter 5 includes a starter case 11 which is adapted to be mounted on one sidewall of the engine 1. This starter case 11 includes a two components forming a cylindrical structure. Inside an outer case member 11A of the starter case 11, which is located away from the engine 1, there is disposed a driving member 6 which is adapted to be revolved as a recoil rope 21 is pulled via a recoil handle 22. Inside an inner case member 11B of the starter case 11, which is located close to the engine 1, there is disposed a driven member 7 which is adapted to be revolved independent of the driving member 6.

In this embodiment, the starter case 11 is preferably made of plastic, and the outer case member 11A is provided, at a portion which is joined with the inner case member 11B (i.e. one end thereof facing the engine 1), with a radially enlarged portion 11C and also with a double-pipe consisting of a long anchoring shaft 12 of small diameter and a short diametrically enlarged shaft 13, which are extended integral with and coaxially from the thickened center of the top board 11*a* thereof. A rope reel 20 having the recoil rope 21 wound therearound is rotatably fitted on the diametrically enlarged shaft 13. A buffering/power-accumulating spiral spring mechanism 15 comprising a buffering/power-accumulating spiral spring 18 as a buffering/power-accumulating member, a spiral spring case 16 acting as an interlocking rotor, and an actuating pulley 17, is rotatably fitted on the protruded end portion of the anchoring shaft 12, i.e. at an intermediate portion between the rope reel 20 and an interlocking pulley 35 constituting a driven member 7 so as to permit the buffering/power-accumulating spiral spring mechanism 15 to rotate independently of the rope reel 20. Additionally, a stopper screw 14 is screw-engaged with the protruded end portion of the anchoring shaft 12.

In this embodiment, the central axial line of the anchoring shaft 12, the rotational axial line of the rope reel 20, the rotational axial line of the buffering/power-accumulating spiral spring mechanism 15, and the rotational axial line of the interlocking pulley 35 constituting the driven member 7 are all disposed so as to lie on the rotational axial line O—O of the crankshaft 2, so that the rotation of the rope reel 20 is enabled to be transmitted via the buffering/power-accumulating spiral spring mechanism 15 and the interlocking pulley 35 to the crankshaft 2 of the internal combustion engine 1.

Figure 7:
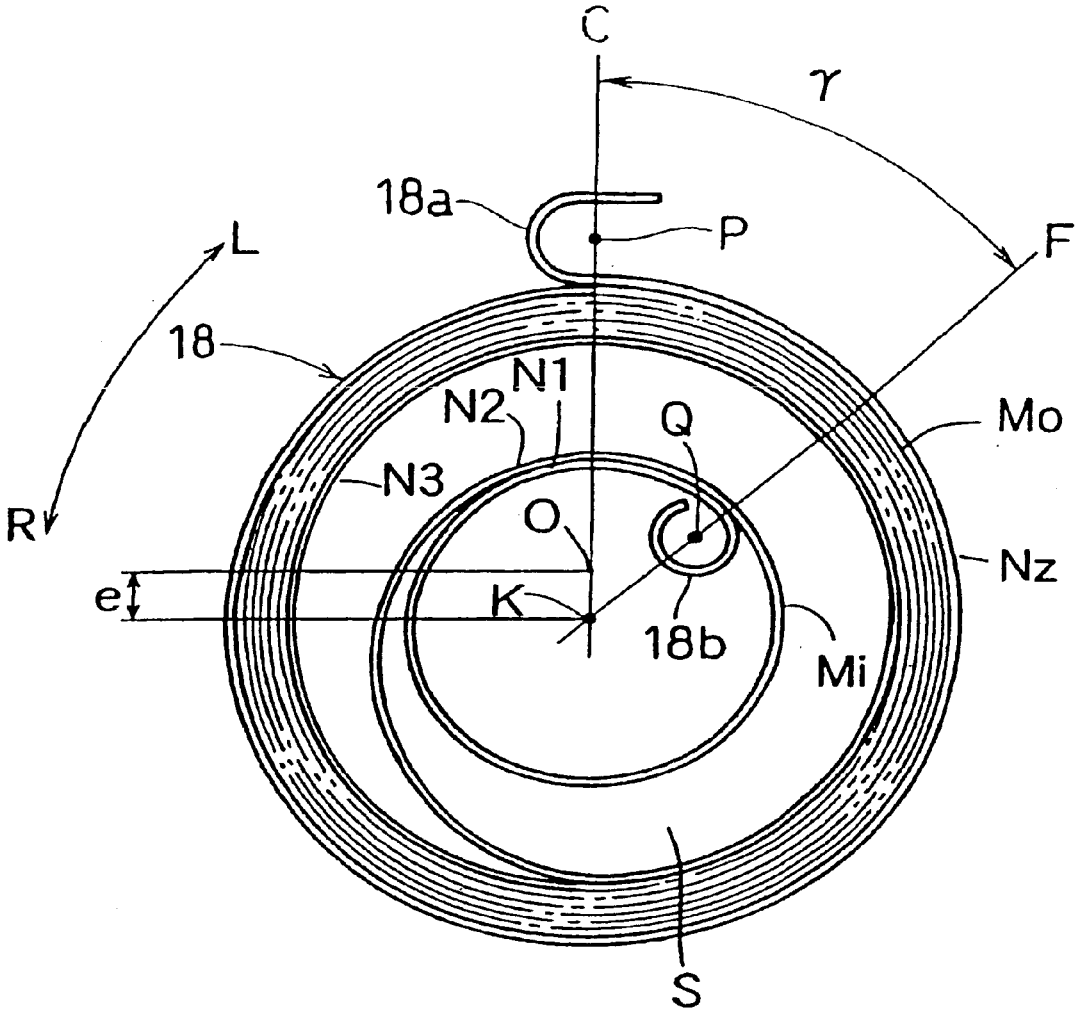
FIG. 7 is an enlarged front view of a spiral spring for use in the recoil starter shown in FIG. 1, illustrating a naturally released state before it is attached to the starter.
Figure 8:
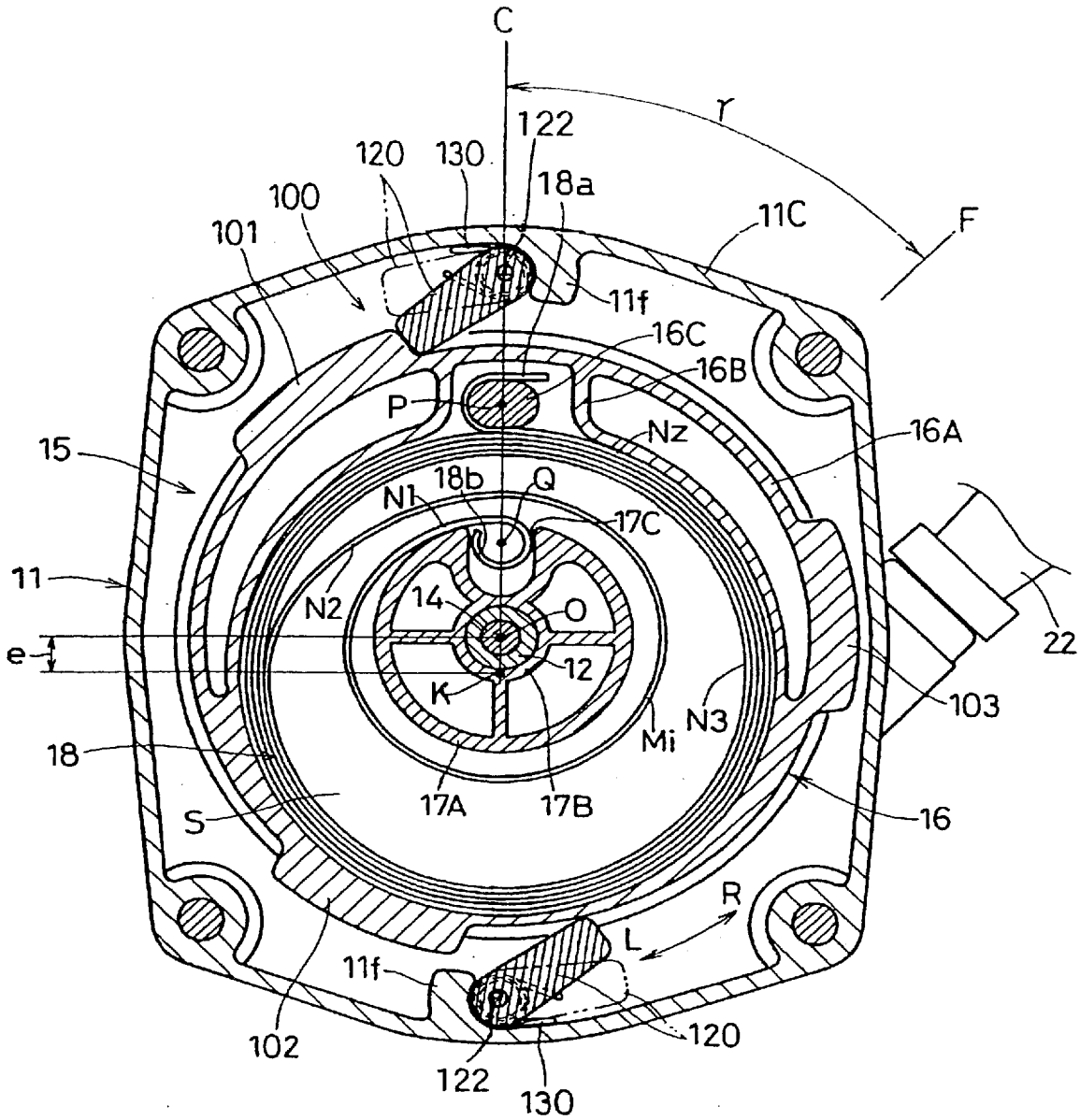
FIG. 8 is a cross-sectional view taken along the line VIII—VIII of FIG. 1.

As illustrated in FIGS. 7 and 8 in addition to FIG. 1, the buffering/power-accumulating spiral spring mechanism 15 includes a spiral spring case 16 which is disposed close to the driving member 6, the actuating pulley 17 which is disposed close to the driven member 7, and the spiral spring 18 which is interposed between the spiral spring case 16 and the actuating pulley 17, wherein the buffering/power-accumulating spiral spring 18 is interposed between the spiral spring case 16 disposed on the input side and the actuating pulley 17 disposed on the output side. Furthermore, the spiral spring case 16 and the actuating pulley 17 are coaxially arranged so as to lie on the same axis, thereby being enabled to be rotated relative to each other. As described hereinafter, the outer end portion of the spiral spring 18 is secured to the spiral spring case 16, while the inner end portion thereof is secured to the actuating pulley 17, so that when either one of the spiral spring case 16 and the actuating pulley 17 is rotated relative to the other, its torque is capable of being transmitted to the other.

More specifically, as clearly shown in FIG. 7, where the spiral spring 18 is shown as it is taken out of the spiral spring mechanism 15 (a freely released state thereof before being assembled), the spiral spring 18 is provided at the outer end portion thereof with a U-shaped external hook end 18*a*, and at the inner end portion thereof with an annular internal hook end 18*b*. In a freely released state of the spiral spring 18, an outer circumferential wound portion Mo, where a predetermined number of turns of the spiral spring 18 are closely contacted, and an inner circumferential wound portion Mi, which includes at least one turn, are formed. A clearance (S) is also provided between the outer circumferential wound portion Mo and the inner circumferential wound portion Mi.

In this embodiment, the outer circumferential wound portion Mo includes a third turn N3 of the spiral spring 18 and the following turns (including the outermost turn Nz) successive to the third turn N3. The inner circumferential wound portion Mi includes a first turn N1 of the spiral spring 18 and at least a portion of the second turn N2 which is in close contact with the first turn N1. Furthermore, in a freely released state of the spiral spring 18 as shown in FIG. 7, the annular internal hook end 18*b* is positioned so as to be displaced from the location of the external hook end 18*a* by a predetermined angle □(40 to 50 degrees in this embodiment) toward the direction L which is opposite to the driving direction R to be explained hereinafter. The angle □ is an angle formed between a straight line C passing through the center K of the spiral spring 18 and through the center P of the external hook end 18*a* (or of an external end-fastening stub 16C which is formed in the spiral spring case 16), and a straight line F passing through the center K of the spiral spring 18 and through the center Q of the internal hook end 18*b* (or of an internal end-fastening portion 17C which is formed in the actuating pulley 17 as explained hereinafter).

The spiral spring 18 is formed of a stainless steel sheet having a thickness of 0.5 to 0.7 mm, and the effective inner diameter of the first turn N1 is set to about 30 mm. An annealing treatment is performed on the inner circumferential wound portion Mi of the spiral spring 18 (at least the first turn N1 and the second turn N2 thereof).

The spiral spring case 16 is provided, at the center of a sidewall thereof facing the driving member 6, with a cylindrical boss portion 16*a*, which is externally and rotatably fitted on the short diametrically enlarged shaft 13. On the outer periphery of the spiral spring case 16, there is disposed, as unidirectional rotating means, a one-way clutch 100 which permits the spiral spring case 16 to rotate only in the driving direction R (in the rewinding direction of the spiral spring 18) (as described in detail hereinafter).

The spiral spring case 16 further includes, on one of its sidewalls facing the driven member 7, a projected short cylindrical portion 16A for housing the spiral spring 18. This spiral spring-housing cylindrical portion 16A is provided with a disengagement-preventing protruded portion 16B which is outwardly projected in the radial direction for housing therein the external hook end 18*a* of the spiral spring 18. Inside this protruded portion 16B, there is disposed the external end-fastening stub 16C having an oval cross-section, which is protruded toward the driven member 7 so as to be fixedly fitted with the external hook end 18*a*.

The actuating pulley 17 is provided, at the center of its sidewall facing the driving member 6, with a projected cylindrical boss portion 17B which is rotatably fitted on the anchoring shaft 12. The cylindrical boss portion 17B is provided on the outer circumferential wall thereof with a core portion 17A around which the spiral spring 18 is designed to be wound. The core portion 17A is provided with an internal end-fastening portion 17C forming a longitudinal groove having a U-shaped cross-section so as to enable a ring-shaped internal hook end 18*b* of the spiral spring 18 to be fitted and engaged therewith.

The outer diameter of the core portion 17A is made almost identical with the effective inner diameter of the first turn N1 of the spiral spring 18. The effective outer diameter of the spiral spring 18 under the freely released condition thereof is made almost identical with the effective inner diameter of the spiral spring-housing cylindrical portion 16A of the spiral spring case 16.

Additionally, according to this embodiment, the rotational axial line O—O of the spiral spring mechanism 15 is displaced from the proper center K of the spiral spring 18 shown in FIG. 7 by a predetermined distance "e" toward the external hook end 18*a*. In other words, under the assembled condition of the spiral spring mechanism 15, where the spiral spring 18 is housed inside the spiral spring-housing cylindrical portion 16A of the spiral spring case 16, where the core portion 17A of the actuating pulley 17 is fitted in the inner circumferential wound portion Mi of the spiral spring 18, and where the external hook end 18*a* and internal hook end 18*b* of the spiral spring 18 are anchored to the external end-fastening stub 16C and the internal end-fastening portion 17C, respectively, the center of the inner circumferential wound portion Mi of the spiral spring 18 is decentered from the proper center K of the spiral spring 18 by the predetermined distance "e" toward the external hook end 18*a*. As a result, the range of contact between the first turn N1 and the second turn N2 of the spiral spring 18 is increased, thereby improving the retention force of the spiral spring 18 to wind around the core portion 17A of the actuating pulley 17.

As clearly shown in FIGS. 1 and 8, the one-way clutch 100 mounted on the outer periphery side of spiral spring case 16 includes a couple of rotatable axles 122 which are mounted on the radially enlarged portion 11C of the outer case member 11A (which is disposed remote from the engine) of the starter case 11 in such a way that they are disposed around the rotational axial line O—O and spaced apart from each other at an angle of 180 degrees, a couple of claw members 120 which are swingably supported by the rotatable axles 122, respectively, a couple of torsion coil springs 130 acting as urging members for urging the claw members 120 radially inward (toward the outer peripheral surface of the spiral spring-housing cylindrical portion 16A), and three engaging portions 101, 102 and 103, which are projected from the outer peripheral wall of the spiral spring-housing cylindrical portion 16A of the spiral spring case 16 and spaced apart from each other at an angle of 120 degrees, respectively. Thus, when any one of the claw members 120 is contacted and engaged with any one of the engaging portions 101, 102 and 103, the spiral spring case 16 is prevented from rotating in the direction L, which is opposite to the driving direction R of the spiral spring case 16.

Each of the claw members 120 is rotatably secured, by means of a C-shaped stopper ring 135, to the rotatable axles 122, and is slidably sustained by a reinforcing receiving portion 11*f* which is formed at the radially enlarged portion 11C of the outer case member 11A.

Figure 2:
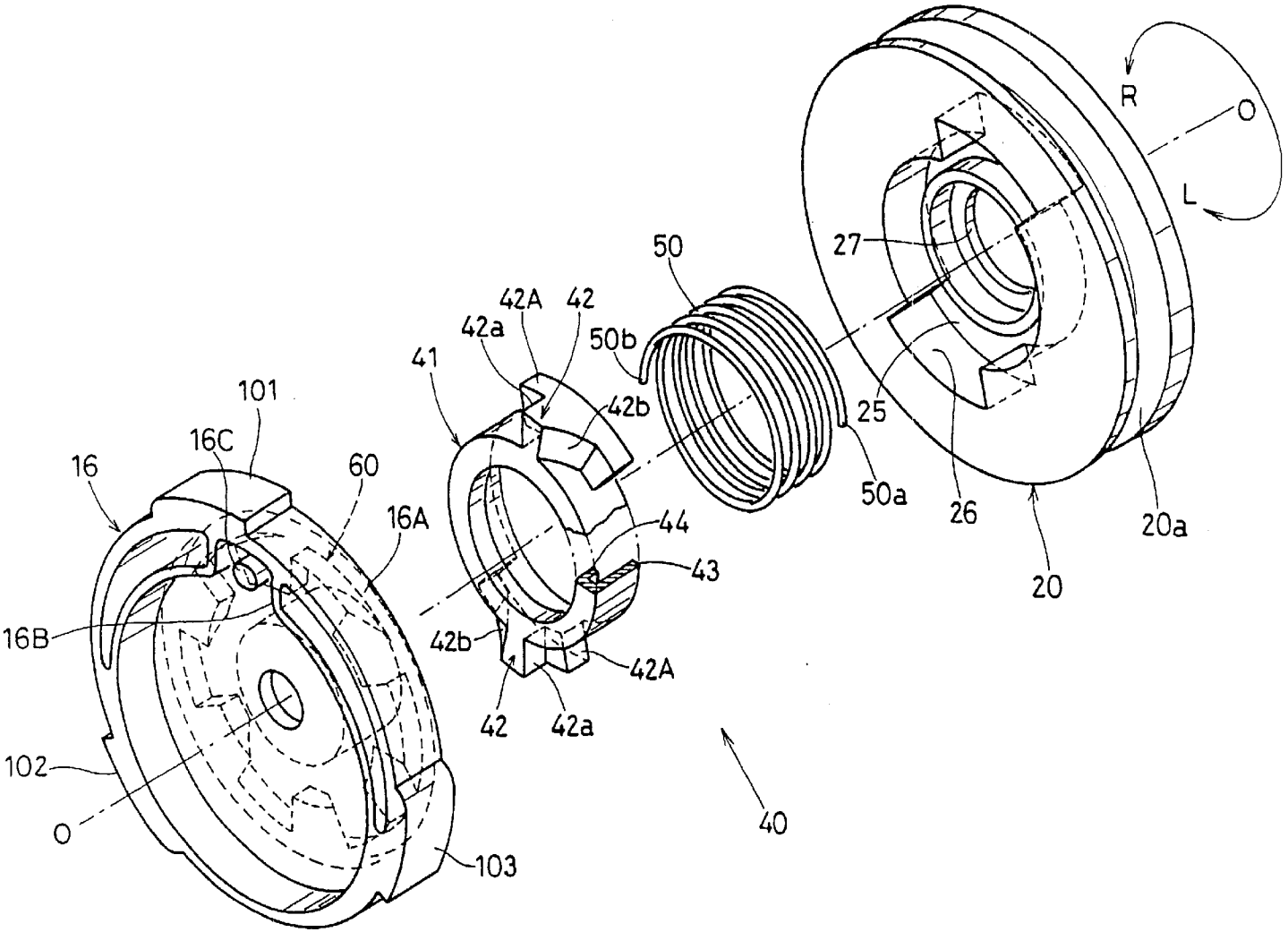
FIG. 2 is a partially cut out exploded perspective view of recoiling unidirectional rotating means, interposed between the rope reel and the spiral spring case, which are designed to be installed in the recoil starter shown in FIG. 1.
Figure 5:
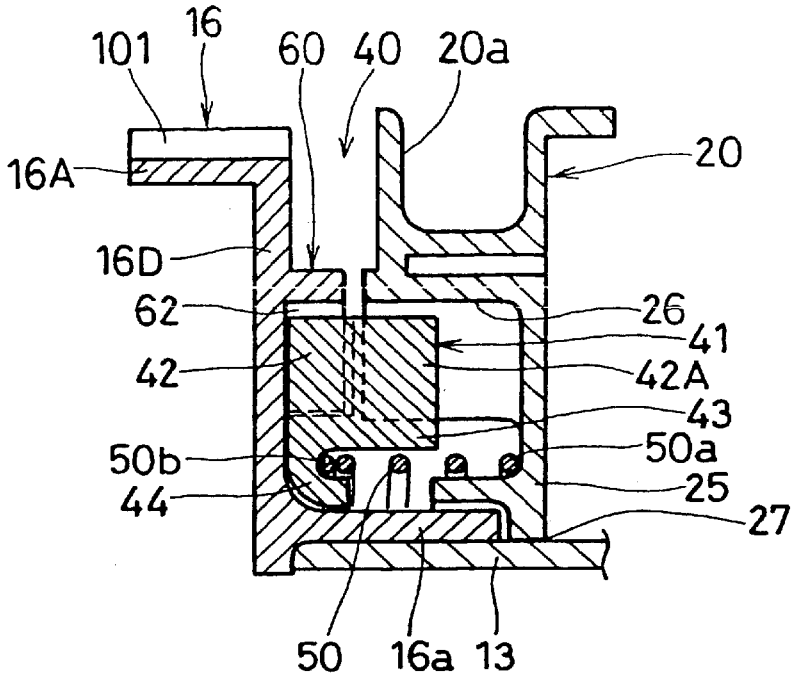
FIGS. 5(A) and 5(B) respectively show a partial enlarged cross-sectional view of the recoiling unidirectional rotating means which is shown in FIG. 1.
Figure 5:
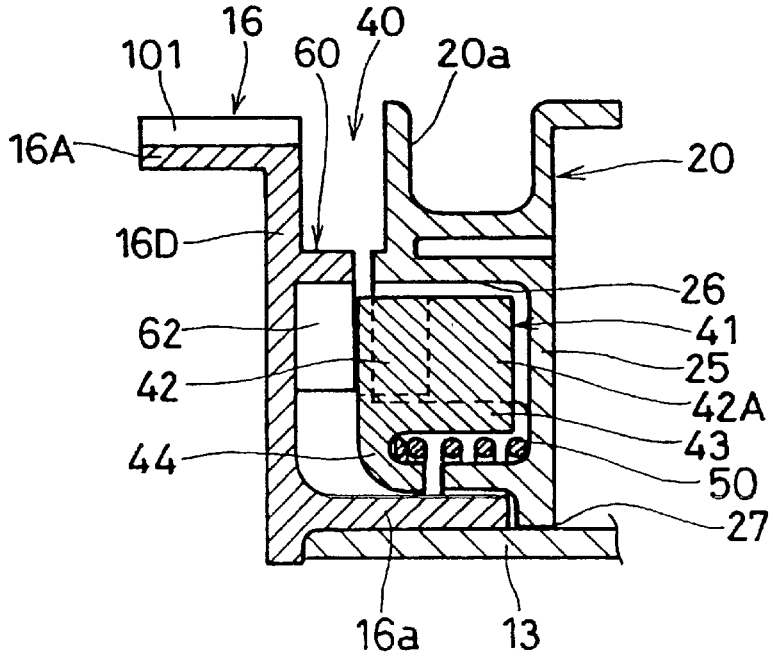

Between the outer case member 11A and the spiral spring case 16, there is disposed a rope reel 20. As shown in FIGS. 2 and 5 in addition to FIG. 1, the rope reel 20 has a stepped disc-like configuration and is provided on the outer peripheral wall thereof with an annular groove 20*a* so as to enable the recoil rope 21 to be wound around it. The rope reel 20 is further provided, at the center of the inner periphery of the substrate 25 thereof, with a hole 27 in which the anchoring shaft 12 is rotatably inserted. Between the annular groove 20*a* and the hole 27 of the substrate 25, there is disposed not only a movable locking claw member 41 of recoiling unidirectional rotating means 40 (to be explained hereinafter), the movable locking claw member 41 being made rotatable together with the rope reel 20, but also a guiding/supporting member 26 which is adapted to be slidably fitted therein, the guiding/supporting member 26 having an opening on the side thereof facing the spiral spring case 16.

Figure 9:
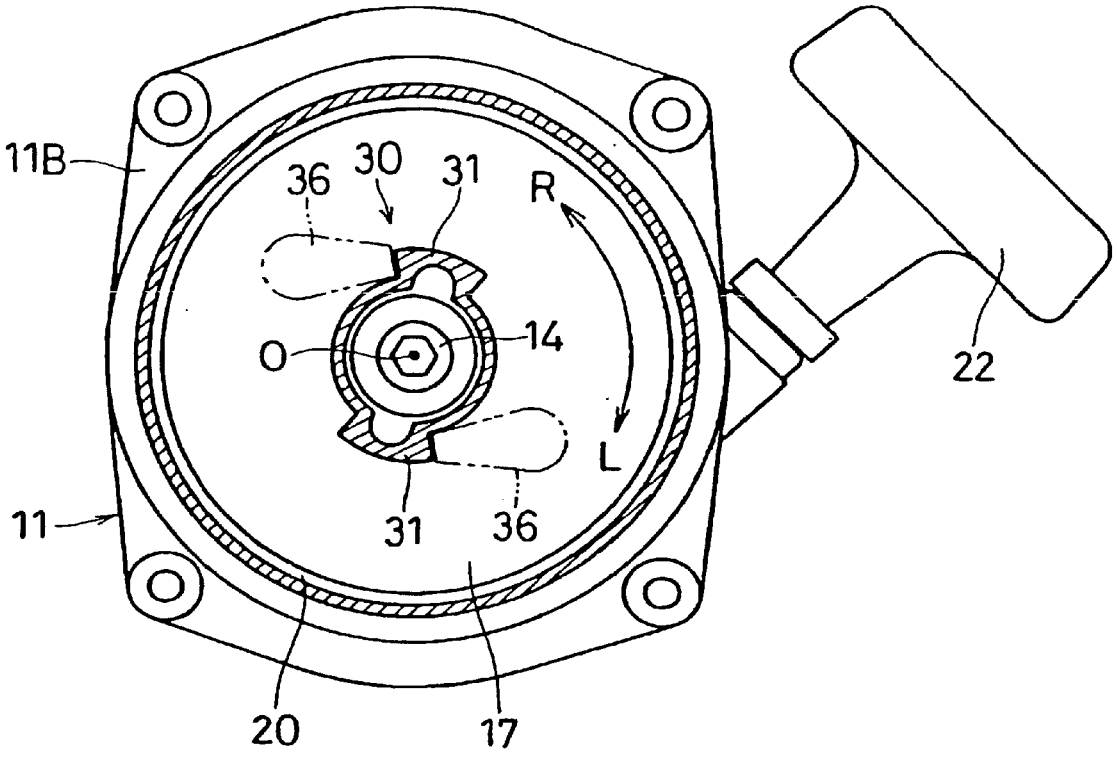
FIG. 9 is a cross-sectional view taken along the line IX—IX of FIG. 1.

In the same manner as in the case of the conventional recoil type starter, although details are not shown in the drawings, one end of the rope 21 is fastened to a bottom portion of the groove 20*a*, while the other end of the rope 21, which is extended out of the outer case member 11A, is fastened to a recoil handle 22 (see FIG. 9).

Furthermore, between the rope reel 20 and the outer case member 11A, there is interposed a recoil spiral spring 23 functioning as recoil urging means, the outer end of which is fastened to the rope reel 20, and the inner end of which is fastened to a central portion of the outer case member 11A. The rope reel 20 is designed to be rotated by pulling the rope 21, and then allowed to return to its original position on account of the restoring force accumulated in the recoil spiral spring 23, thereby enabling the rope 21 to be automatically rewound.

The recoiling unidirectional rotating means 40 is interposed between the rope reel 20 and the spiral spring case 16.

Figure 3:
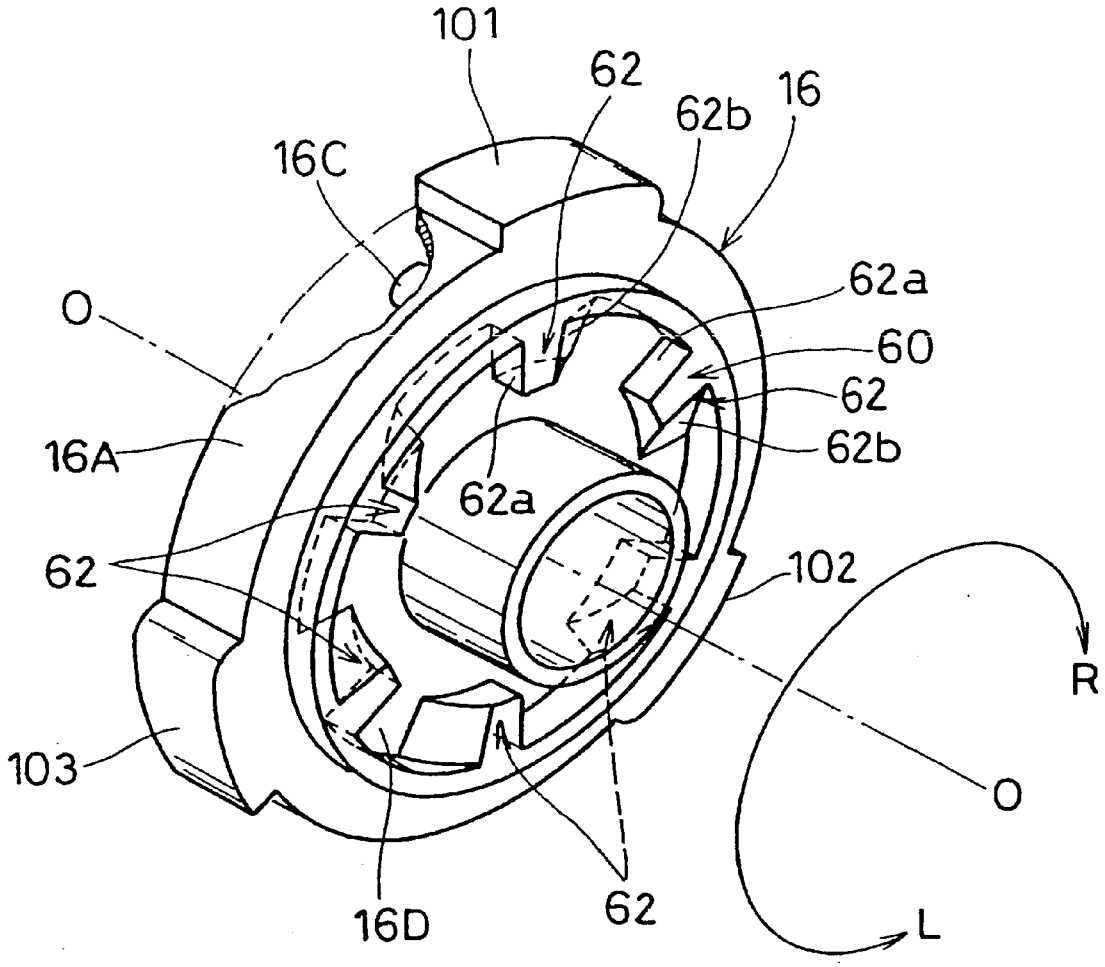
FIG. 3 is a perspective view showing the disc plane side of the spiral spring case which is to be mounted on the recoil starter shown in FIG. 1.

As clearly seen from FIGS. 1 and 2, the recoiling unidirectional rotating means 40 includes a movable locking claw member 41, which is sustained by a guiding/supporting member 26 provided in the rope reel 20 in such a manner that it is made rotatable together with the rope reel 20 and slidable in the direction along the rotational axial line O—O, a compression coil spring 50 urging the movable locking claw member 41 to move toward the spiral spring case 16 and externally inserted together with the rope reel 20 over the diametrically enlarged shaft 13, and an engaging member 60 formed on a base portion 16D of the spiral spring case 16, which faces the rope reel 20 (FIG. 3).

Figure 4:
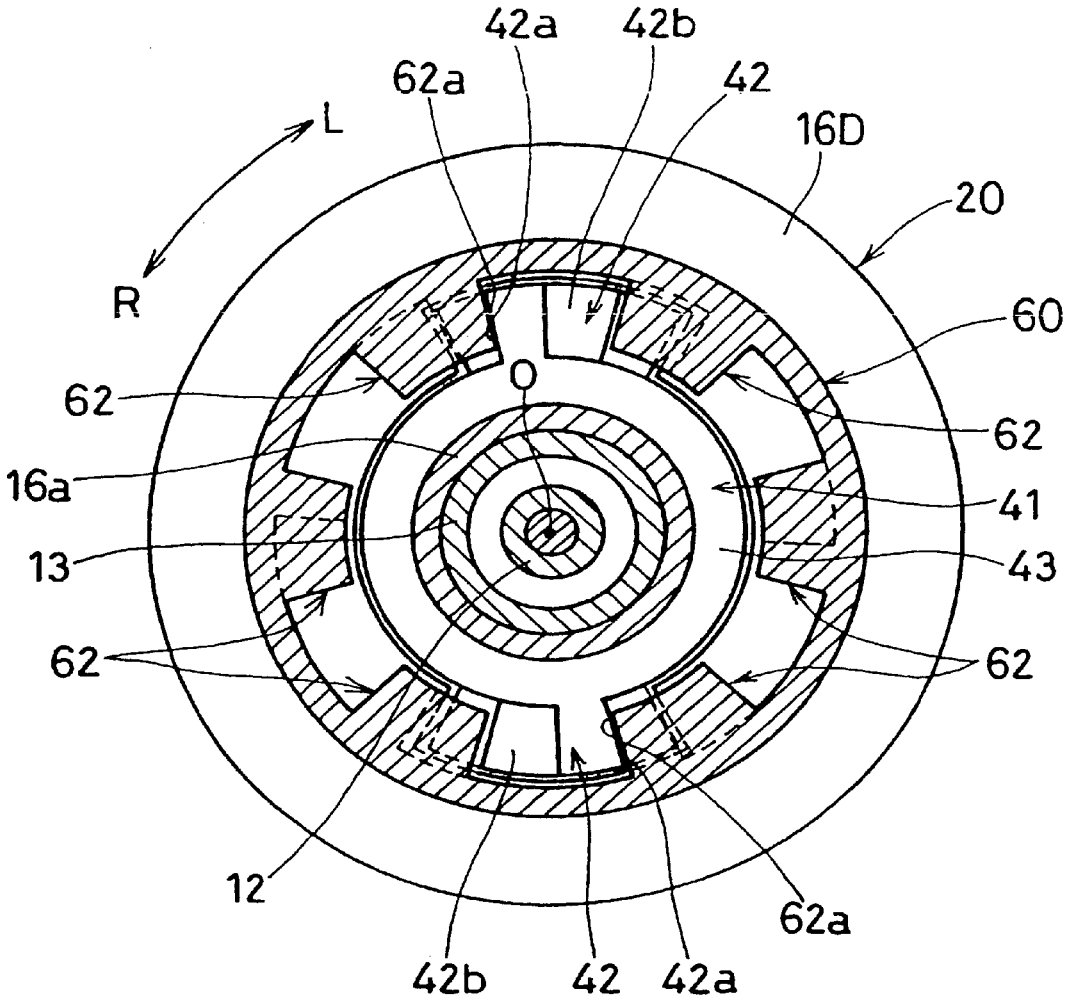
FIG. 4 is a cross-sectional view taken along the line IV—IV of FIG. 1.

As clearly seen from FIGS. 4 and 5 in addition to FIG. 2, the movable locking claw member 41 includes a central boss portion 43 provided with an annular groove-like spring-receiving portion 44 for receiving one end 50*b* of the compressing coil spring 50, the other end 50*a* of which is received by the substrate 25 of the rope reel 20. A couple of locking claws 42, which are formed integral with the outer periphery of the central boss portion 43 and around the rotational axial line O—O, are spaced apart from each other by an angle of 180 degrees.

A couple of locking claws 42 have the same size and configuration, and respectively include a locking face 42*a*, which is formed perpendicular to the rotational directions R and L, and an inclined face 42*b*, which is located behind the locking face 42*a* in the driving direction R. Both the locking face 42*a* and the inclined face 42*b* are formed on a sector-shaped base portion 42A, which is designed to be slidably inserted into the guiding/supporting member 26 of the rope reel 20.

An engaging member 60 of the spiral spring case 16 is provided with six engaging claws 62 which are spaced apart at an angle of 60 degrees around the rotational axial line O—O. The six engaging claws 62 have the same size and configuration, and respectively include an engaging face 62*a*, which is formed perpendicular to the rotational directions R and L, and an inclined face 62*b*, which is located in front of the engaging face 62*a* in the driving direction R and inclined at the same angle and in the same direction as those of the inclined face 42*b* of the locking claw 42 of the movable locking claw member 41.

Figure 6:
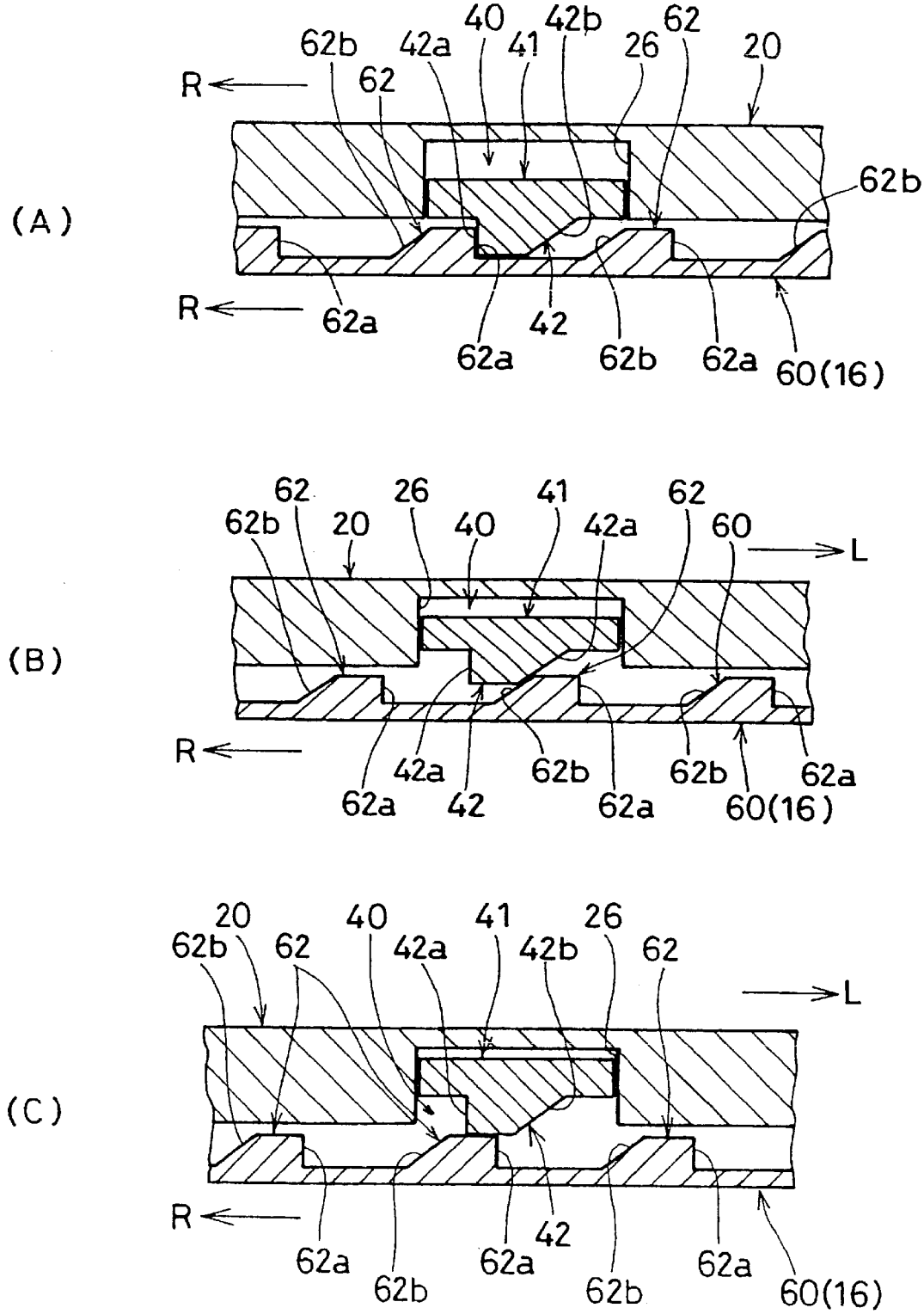
FIGS. 6(A) to 6(C) respectively show a partial enlarged cross-sectional view for schematically explaining the operation of the recoiling unidirectional rotating means which is shown in FIG. 1.

In the recoil starter 5 of this embodiment, which is constructed as described above, when the recoil rope 21 (recoil handle 22) is pulled to revolve the rope reel 20 in the driving direction R so as to start an internal combustion engine 1, the recoil spiral spring 23 is wound and, at the same time, the movable locking claw member 41, which is slidably fitted in the guiding/supporting portion 26 of the rope reel 20, is also caused to rotate together with the rope reel 20 in the same direction R. In this case, since the movable locking claw member 41 is being urged to move toward the spiral spring case 16 by the compression coil spring 50, the locking faces 42*a* of the locking claws 42 are permitted to contact and engage with the engaging faces 62*a* of a couple of the engaging claws 62, which are spaced apart at an angle of 180 degrees from each other around the rotational axial line O—O among six engaging claws 62 of the engaging member 60 formed on the spiral spring 60, immediately after the initiation of the rope-pulling operation (starting operation) as shown in FIGS. 4, 5(A) and 6(A), thereby enabling the torque of the rope reel 20 to be transmitted to the spiral spring case 16. As a result, the rope reel 20 is permitted to rotate together with the spiral spring case 16 in the same direction (in the driving direction R), this rotation being successively transmitted via the driven member 7 to the crankshaft 2 of the internal combustion engine 1 to thereby achieve the engine ignition.

Once the engine 1 has been started, the recoil rope 21 is released and the rope reel 20 is forced to rotate reversibly to the driving direction R by the effect of the recoil spiral spring 23 so as to rewind the recoil rope 21. At this moment, as shown in FIGS. 5(B), 6(B) and 6(C), the inclined face 42*b* of the locking claw 42 of the movable locking claw member 41 can not be engaged with the inclined face 62*b* of the engaging claw of the engaging member 60 even though these inclined faces are permitted to slidably contact each other. As a result, while permitting the six engaging claws 62 to successively pass over the locking claws 42, the movable locking claw member 41 (the locking claws 42) is caused to move toward the rope reel 20 against the urging force of the compression coil spring 50, thereby permitting the engaging claws 62 to disengage from the locking claws 42, whereby the rope reel 20 and the spiral spring case 16 are permitted to individually rotate in the directions opposite to each other.

As explained above, since the recoiling unidirectional rotating means 40, which is mounted on the recoil starter of the present invention, is constructed such that the engagement and disengagement between the locking claws 42 and the engaging claws 62 of spiral spring case 16 can be executed by entirely moving the movable locking claw member 41 provided with the locking claws 42 in the direction along the rotational axial line O—O, a plurality of locking claws are no longer required to be supported in a manner that each of the locking claws is enabled to individually oscillate, as seen in the case of the conventional ratchet mechanism provided with oscillating locking claws. Furthermore, the movable locking claw member 41 is only required to be urged to move toward the spiral spring case 16 by making use of a single compression coil spring 50. The locking claws 62 are no longer required to be separately provided with an individual urging member. As a result, it is now possible to reduce the number of parts to be employed, to simplify the structure of the recoil starter, and to easily assemble and attach the recoil starter, thus making it possible to effectively reduce the manufacturing cost thereof.

When the operation of pulling the rope is performed in this manner, the torque of the driving member 6 can be transmitted, via the spiral spring mechanism 15 and the interlocking pulley 35, to the crankshaft 2 of the engine 1.

In this case, during the first-half of the driving process (until the piston of the engine 1 reaches the top dead center of the internal combustion engine) in the operation of pulling the recoil rope 21 (recoiling operation), it is possible to derive a buffering effect from the spiral spring mechanism 15, and at the same time, to accumulate the pulling force of the recoiling rope 21 in a spiral spring mechanism 15. During the second-half of the driving process, the pulling force thus accumulated in the spiral spring mechanism during the first-half of the driving process is combined with the pulling force to be actually effected by the recoiling rope 21 in the second-half of the driving process to thereby generate a resulting force of sufficient energy to overcome the load of the engine compression, thus providing sufficient energy for starting the engine 1. As a result, it is possible to minimize fluctuation in the pulling force of the rope so as to allow for a smooth rope-pulling operation, thus enabling even a person having weak physical strength to easily start the engine (for more details, see Japanese Patent Application No. H11-238642).

When the pulling movement of the recoil rope 21 is released due to the start-up of the engine 1, the rope reel 20 is caused to reversibly rotate (the rotation in the reverse direction L) due to the restoring force that has been accumulated in the recoiling spiral spring 23, thereby allowing the recoil rope 21 to be automatically rewound. However, the rope reel 20 is also caused to reversibly rotate, thereby enabling any one of the claw members 120 in the one-way clutch 100 to contact and engage with any one of the engaging portions 101, 102 and 103 formed on the outer periphery of the spiral spring case 16 as shown in FIG. 8, so that the spiral spring case 16 can be prevented from rotating in the reverse direction L. As a result, the accumulated force of the spiral spring 18 is prevented from being released in vain.

According to the starter 5 of the embodiment described above, since the one-way clutch 100 provided for rotating the spiral spring case 16 of the spiral spring mechanism 15 in only driving direction R is disposed on the outer peripheral side of the spiral spring case 16, the diameter of the one-way clutch 100 can be made fairly large. As a result, it is now possible to enable the one-way clutch 100 to sustain a large magnitude of torque. Additionally, since it is no longer required for each of the parts constituting the recoil starter to have high mechanical strength, high rigidity and high working precision, the manufacturing cost for the recoil starter can be reduced, and the reliability of the recoil starter can be enhanced. At the same time, it is now possible to reduce the weight of the recoil starter by making use of plastic materials as much as possible.

Furthermore, in the case of the recoil starter 5 according to this embodiment, since it is constructed such that part of the second turn N2 is closely contacted with the first turn N1 at the inner circumferentially wound portion Mi of the spiral spring 18, that the internal hook end 18*b* is displaced as mentioned above, and that the specifications of the spiral spring 18 and the spiral spring mechanism 15 are designed as explained above, the interlocked spiral spring mechanism 15 and engine 1 can be disengaged from each other after the start-up of the engine due to the free releasing effects obtained from the centrifugal ratchet mechanism 30 mounted on the driven member 7, thereby rendering the spiral spring mechanism 15 into a free state. In this case, even if the spiral spring 18 is excessively kicked back in the unwinding direction (releasing direction) thereof due to the inertia, even after the spiral spring 18 has been completely unwound, the kick-back stress to be repeated by the effects of rewinding-unwinding on this occasion can be received by the entire body of the inner circumferentially wound portion Mi, thereby making it possible to suppress the concentration of the stress in the vicinity of the internal hook end 18*b* of the spiral spring 18.

As a result, the generation of settling or breakage of the spiral spring 18 can be prevented, thereby making it possible to improve the durability of the spiral spring 18, and at the same time, the internal hook end 18*b* of the spiral spring 18 can be prevented from being easily disengaged from the core portion 17C provided at the actuating pulley 17 of the spiral spring mechanism 15, thereby further improving the reliability of the recoil starter.

While one embodiment of the present invention has been explained in detail for the purpose of illustration, it will be understood that the construction of the device can be varied without departing from the spirit and scope of the invention.

For example, while the movable locking claw member 41 may be disposed close to the rope reel 20, with the engaging member 60 being disposed close to the spiral spring case 16 employed as an interlocking rotor, this positional relationship between the movable locking claw member 41 and the engaging member 60 may be reversed. Furthermore, the configuration as well as the number of the locking claws 42 and of the engaging claws 62 are not confined to the above embodiment and may be optionally selected.

It will be clear from the above explanation that it is possible, according to the present invention, to provide a recoil starter having recoiling unidirectional rotating means, which is reasonably simple in structure and can be easily assembled and attached, thereby making it possible to effectively reduce the manufacturing cost of the recoil starter.

What is claimed is:

1. A recoil starter, comprising:

a driving member having a rope reel, recoiling urging means for reversibly rotating the rope reel, and an interlocking rotor to which the rotation of the rope reel is enabled to be transmitted; and a driven member operationally coupled to said driving member, to which the rotation of said driving member is transmitted;

said driving member further comprising recoiling unidirectional rotating means operationally coupled to said interlocking rotor, said recoiling unidirectional rotating means including a movable locking claw member supported by one of said rope reel and said interlocking rotor in such a manner that it is rotatable integrally therewith and movable in a direction along the rotational axis thereof;

an urging member for urging said movable locking claw member toward the other of said rope reel and said interlocking rotor; and an engaging member mounted on the other of said rope reel and said interlocking rotor;

said unidirectional rotating means being constructed in such a manner that when said rope reel is rotated in the driving direction, said movable locking claw member is caused to contact and engage with said engaging member to thereby enable said rotation of the rope reel to be transmitted to said interlocking rotor, and when said rope reel is rotated reversibly to said driving direction relative to said interlocking rotor, the engagement between said movable locking claw member and said engaging member is released;

a buffering/power-accumulating means disposed between said driving member and said driven member, said buffering/power-accumulating means being a spiral spring mechanism that is thereby enabled, during the driving process by the driving member, to accumulate the power supplied by the driving process while alleviating any impact to be imposed by the driving member, the accumulated power being subsequently employed for driving the driven member.

2. The recoil starter according to claim 1, wherein said buffering/power-accumulating means comprises unidirectional rotating means for enabling said interlocking rotor to rotate only in the driving direction.

* * * * *